US007078358B2

(12) United States Patent
Roberts et al.

(10) Patent No.: US 7,078,358 B2
(45) Date of Patent: Jul. 18, 2006

(54) LOW VOC CLEANROOM CLEANING WIPE

(75) Inventors: David Allen Roberts, Encinitas, CA (US); John Anthony Marsella, Allentown, PA (US); Robert Edward Stevens, Wescosville, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 476 days.

(21) Appl. No.: 09/847,883

(22) Filed: May 3, 2001

(65) Prior Publication Data

US 2002/0006759 A1 Jan. 17, 2002

Related U.S. Application Data

(63) Continuation-in-part of application No. 09/544,921, filed on Apr. 7, 2000, now abandoned.

(60) Provisional application No. 60/133,094, filed on May 7, 1999.

(51) Int. Cl.
*B01F 17/00* (2006.01)

(52) U.S. Cl. ..... 442/59; 15/208; 15/209.1; 15/210.1; 442/181; 442/226; 442/327; 510/109; 510/110

(58) Field of Classification Search ..... 510/438, 510/175, 165, 505, 109, 110; 15/104.93, 15/208, 209.1, 210.1; 428/320.2, 321.1; 442/59, 181, 226, 327

See application file for complete search history.

(56) References Cited

U.S. PATENT DOCUMENTS

| | | | | | |
|---|---|---|---|---|---|
| 3,728,269 | A | | 4/1973 | Stephenson et al. | 252/171 |
| 3,819,522 | A | | 6/1974 | Zmoda et al. | 252/89 |
| 3,979,317 | A | * | 9/1976 | Angelini | 134/38 |
| 4,054,534 | A | * | 10/1977 | Angelini | 134/40 |
| 4,117,249 | A | | 9/1978 | DeSimone et al. | 568/855 |
| 4,328,279 | A | | 5/1982 | Meitner et al. | 428/289 |
| 4,689,168 | A | | 8/1987 | Requejo | 252/139 |
| 4,847,089 | A | | 7/1989 | Kramer et al. | 424/405 |
| 4,931,201 | A | * | 6/1990 | Julemont | 15/104.93 |
| 5,259,993 | A | | 11/1993 | Short | 252/542 |
| 5,389,281 | A | | 2/1995 | Davies et al. | 252/170 |
| 5,466,389 | A | | 11/1995 | Ilardi et al. | 252/156 |
| 5,650,543 | A | * | 7/1997 | Medina | 568/616 |
| 5,664,677 | A | | 9/1997 | O'Connor | 206/494 |
| 6,017,872 | A | * | 1/2000 | Pedersen et al. | 510/424 |
| 6,159,487 | A | * | 12/2000 | Znaiden et al. | 424/402 |
| 6,189,189 | B1 | * | 2/2001 | Morin et al. | 28/166 |
| 6,284,718 | B1 | * | 9/2001 | Simon | 510/136 |

FOREIGN PATENT DOCUMENTS

| | | | |
|---|---|---|---|
| AT | 257015 | | 9/1967 |
| EP | 0343304 | | 12/1988 |
| EP | 0917852 | | 5/1999 |
| JP | 10259397 | | 8/1998 |
| US | EP0389612 B | * | 6/1994 |
| US | EP0830890 A | * | 3/1998 |
| WO | 9915609 | | 4/1999 |

OTHER PUBLICATIONS

"Sponge". Merriam-Webster Online Dictionary, 2004.*

"*Characterization of Low and Non Volatile Organic Compound Containing Cleaners For Cleanroom Work Surfaces*", Chem. Abstract 121: 159750, 1st Inter. Sample Envir. Conference, May 21-23, '91 Abstract: Austrian Patent AU 257015., Sep. 25, 1967.

J. Liq. Chrom. vol. 10, 1987, pp. 561-581.

* cited by examiner

*Primary Examiner*—Terrel Morris
*Assistant Examiner*—Jennifer Boyd
(74) *Attorney, Agent, or Firm*—Geoffrey L. Chase

(57) ABSTRACT

A prewetted cleaning wipe for cleaning surfaces and having low volatile organic chemical and low nonvolatile residue properties comprising a wipe substrate wetted with an aqueous solution of high purity water and an effective amount of an acetylenic alcohol surface active agent. The surface active agent is preferably an acetylenic diol. Preferred acetylenic diols include dimethyl octynediol and tetramethyl decynediol.

18 Claims, No Drawings

LOW VOC CLEANROOM CLEANING WIPE

CROSS-REFERENCE TO RELATED APPLICATIONS

This is a continuation-in-part of U.S. Provisional Patent Application Ser. No. 60/133,094 filed May 7, 1999 and U.S. patent application Ser. No. 09/544,921 filed 7 Apr. 2000 now abandoned.

STATEMENT REGARDING FEDERALLY SPONSORED RESEARCH OR DEVELOPMENT

Not applicable.

BACKGROUND OF THE INVENTION

The electronics fabrication industry typically requires ultra clean surfaces in fabrication areas, such as clean rooms, due to the extremely small electrical lines and devices and the density of lines and devices that are currently demanded by customers of electronic circuits, such as integrated circuits, typically found in computer chips and memory devices.

Electronic fabrication industry machines and surfaces surrounding the machines and work areas are typically cleaned by wiping down the surfaces with towels, wipes and wipes prewetted with various solvents, wetting agents and cleaning solutions.

Solutions of isopropyl alcohol (IPA) in water have been used to provide the necessary wetting for efficient cleaning of clean room equipment and surfaces such as benchtops. The solutions leave no residue and provide surface tensions of about 45 dynes/cm at ~6 wt % IPA. Although these solutions perform well, the semiconductor industry is under increasing pressure to reduce the emission of volatile organic chemicals (VOC's).

The intense pressure to reduce VOC emissions is of relatively recent origin. U.S. Pat. No. 4,328,279 describes the use of completely non-volatile anionic and nonionic surfactants to enhance the wetting of the fibers in a cleaning wipe. These surfactants would be expected to leave a residue on a cleanroom surface.

Acetylenic alcohols and glycols have been reported to be effective as additives in cleaning mirrors and lenses in the presence of relatively large amounts of a lower alcohol, such as ethanol and ammonia, see U.S. Pat. No. 4,054,534.

A similar solution was found to be effective for cleaning photoreceptors, as described in U.S. Pat. No. 3,979,317.

U.S. Pat. No. 3,728,269 describes the use of a mixture of a series of alcohols, including small amounts of 3,5-dimethyl-1-hexyn-3-ol, for cleaning surfaces.

Similarly, U.S. Pat. No. 4,689,168 describes the use of solutions containing 3,5-dimethyl-1-hexyn-3-ol, along with other surfactants in a hard surface cleaning formulation. This disclosure specifically states that the cleaning solution must form an emulsion on agitation.

U.S. Pat. No. 3,819,522 describes the use of ethoxylated acetylenic glycols in anti-fogging window cleaners, which require an anionic sulfate to make the glycol acceptable.

Austrian Patent 257,015 (Chemical Abstract 67:118464) discloses the use of 3,5-dimethyl-1-hexyn-3-ol, along with an amine and non-volatile surfactant for cleaning glass.

Finally, a technical article discusses evaluation of solutions low- and non-volatile organic compounds as replacements for high VOC cleaning formulations in clean rooms; Chemical Abstracts 121:159750, Allison et al., Characterization of Low and Non Volatile Organic Compound Containing Cleaners for Cleanroom Work Surfaces, 1st Int. SAMPE Environ. Conf., May 21–23, 1991.

Acetylenic alcohols are known surface active agents as described in U.S. Pat. No. 4,117,249.

Ethoxylated acetylinic glycols are disclosed in U.S. Pat. No. 5,650,543 as being effective surfactants.

Additional references of interest include: U.S. Pat. Nos. 4,847,089; 4,931,201; 5,259,993; 5,389,281; 5,466,389; 5,650,543 and 6,017872.

The prior art has attempted to provide an effective clean room wipe, such as represented by U.S. Pat. No. 4,328,279, but has failed to achieve low VOC, low nonvolatile residue (NVR), while avoiding the effects of detergency (foaming), in providing an effective prewetted wipe meeting the criteria of the electronics fabrication industry and the requirements of municipal and national environmental regulations on emissions of various organics. The present invention overcomes the drawbacks of the prior art and achieves the requirements of the electronics fabrication industry and municipal and national environmental regulations in a novel prewetted wipe having unexpected superior performance as will be set forth in greater detail below.

BRIEF SUMMARY OF THE INVENTION

The present invention is a prewetted cleaning wipe for cleaning surfaces and having low volatile organic chemical and low nonvolatile residue properties comprising a wipe substrate wetted with an aqueous solution of water and an effective amount of an acetylenic alcohol surface active agent.

Preferably, the surface active agent is an acetylenic diol.

Preferably, the surface active agent is dimethyl octynediol. Alternatively, the surface active agent is tetramethyl decynediol.

BRIEF DESCRIPTION OF SEVERAL VIEWS OF THE DRAWINGS

Not Applicable

DETAILED DESCRIPTION OF THE INVENTION

Because of regulatory pressures, the electronics fabrication industry are under increasing pressure to reduce emissions of volatile organic chemicals. The present invention has unexpectedly found that the use of acetylenic alcohols in aqueous solution allows for efficient surface wetting at greatly reduced levels of VOCs and NVRs.

Preferably, the prewetted cleaning wipe of the present invention has low VOC levels of no greater than 0.001 to 0.5 wt. %, more preferably no greater than 0.01 to 0.3 wt. % most preferably no greater than 0.05 to 0.2 wt. %

In order to assure that no long term build-up of surfactant residue occurs on the surface (i.e., low NVR), suitable surfactants should preferably have a vapor pressure of at least $1\times10^{-4}$ torr at room temperature (25° C.). Most preferably, the surfactant should have a vapor pressure of at least $1\times10^{-3}$ torr at room temperature.

Historically, solutions of isopropyl alcohol (IPA) in water have been used to provide the necessary wetting for efficient cleaning of cleanroom equipment and bench tops. The solutions leave no residue and provide a surface tension of ~45 dyne km at 6% IPA.

Attempts in the past to conduct such cleaning have dealt largely with the use of traditional surfactants, which can leave a residue or nonvolatile residue (NVR). The acetylenic diols and their various chemical derivatives are volatile and will not lead to a build-up of NVR residues. At the same time, the acetylenic diols and their derivatives are very surface active without foaming properties, allowing them to be used in aqueous solutions at much lower concentrations than previous surfactants, thus resulting in much lower volatile organic chemicals or VOC, as well as less inclination to leave nonvolatile residues or NVR.

The present invention is directed to the use of completely volatile high surface active wetting agents with ultrapure water prewetted on a wiper. Table 1 shows the efficacy of various acetylenic alcohols and preferably diols, such as Surfynol 61, 82 and 104 available from Air Products and Chemicals, Inc. of Allentown, Pa., in reducing the surface tension of water, which provides the necessary wetting for cleaning applications. Much lower quantities of these agents are needed to reduce the surface tension than is the case for isopropyl alcohol. For comparison, the surface tension of 4 wt % IPA is 50 dynes/cm (J. Liq. Chrom. Vol.10,1987, pp 561–581).

TABLE 1

| Additive | conc. to give 52 dynes/cm (wt %) |
|---|---|
| 3,5-dimethyl-1-hexyn-3-ol | 0.11 |
| dimethyl octynediol | 0.20 |
| tetramethyl decynediol | 0.004 |

The acetylenic diols of the present invention include dimethyl octynediol, (Surfynol 82); tetramethyl decynediol (Surfynol 104); 2,6,9,13-tetramethyl-2,12-tetradecadien-7-yne-6-9-diol; 2,6,9-trimethyl-2-decen-7-yne-6-9-diol; 7,10-dimethyl-8-hexadecyne-7,10-diol; 2,4,7,9-tetramethyl-5-decyne-4,7-diol; 4,7-dimethyl-5-decyne-4,7-diol; 3,6-diethyl-4-octyne-3,6-diol; 2,5-dicycloprpyl-3-hexyne-2,5-diol; 2,5-diphenyl-3-hexyne-2,5-diol; 2,5,8,11-tetramethyl-6-dodecyne-5,8-diol.

The effective amount of acetylenic alcohol or diol in water is in the range of approximately 0.001% to 0.5% by weight, preferably in the range of approximately 0.01% to 0.3% by wt., and most preferably in the range of approximately 0.05% to 0.2% by wt. This effective amount is that necessary to dissolve or solubilize the typical contaminants found in a electronics fabrication clean room environment.

The wipe or towelette substrate which is prewetted with the aqueous acetylenic diol can be a woven or nonwoven fibrous sheet. The fibers can be natural fibers, such as cotton or abaca, or the fibers can be synthetic fibers such as polyester, nylon, polyester/cellulose, rayon, polypropylene, rayon/polyester, polypropylene/cellulose, polyurethane, cotton/polyester. The wipe or towelette can be multi-layered or single layered. The wipe or towelette could be in a continuous roll with serated separation seams or they could be individual sheets packaged in a stacked form in a package or sealed container. Each wipe or towelette could be individually packaged in a sleeve or envelope for high purity storage before use. Alternatively, the prewetted substrate could be in the form of a natural or synthetic sponge or pad.

The high purity water is typically a deionized water (DI water) or it can be filtered and distilled for high purity.

The present invention achieves its unexpected performance in lowering both VOC and NVR by utilizing the ability of these acetylenic alcohols and preferably diols at low concentrations to greatly reduce the surface tension of water in comparison to previously used surfactants, while not leaving an involatile residue because of favorably higher vapor pressures of such alcohols and while also providing a substantial decrease in the level of VOC's emitted due to the lower concentrations required to get wetting and detergency. These acetylenic alcohols and preferably diols have very high surface active capability and can reduce the surface tension of water to well below 40 dynes/cm at concentrations below 1 wt %. This high surface active property allows the use of correspondingly less surface active agent (approximately 0.001% to 0.5% by weight, preferably approximately 0.01% to 0.3% by wt., most preferably approximately 0.05% to 0.2% by wt.) to achieve the necessary surfactant performance for the cleaning utility. In addition, the acetylenic alcohols and preferably diols have very low foaming characteristics.

This approach is superior to that known in the art because it reduces the level of VOCs and NVRs at the same time in the cleaning formulation, which parameters are typically thought to be mutually inconsistent goals. Reduced VOC would typically be thought to result in greater NVR, while lessened NVR would typically be thought to increase VOC. Reduction in both these parameters is the unexpected result of the present invention. This is particularly critical to the electronics fabrication industry, such as in the production of semiconductor materials, silicon crystal growing, electronic device fabrication, optical fiber production, integrated circuit production and circuit board fabrication, assembly and packaging.

The present invention has been set forth with regard to several preferred embodiments, but the full scope of the present invention should be ascertained by the claims which follow.

The invention claimed is:

1. A prewetted cleaning wipe for cleaning surfaces in an electronic materials fabricating area having a low volatile organic chemical content in the range of 0.001% to 0.5% by weight and low nonvolatile residue property of at least $1\times10^{-4}$ torr at 25° C. comprising; a woven fibrous polyester/cellulose wipe substrate wetted with an aqueous solution consisting essentially of high purity water selected from the group consisting of distilled water and deionized water, and from 0.001% to 0.5% by weight of an acetylenic diol surface active agent selected from the group consisting of dimethyl octynediol, tetramethyl decynediol and mixtures thereof.

2. The cleaning wipe of claim 1 wherein the acetylenic diol surface active agent is present in an amount from 0.05% to 0.2% by weight.

3. In a cleaning wipe for use in cleaning an electronics fabrication industry clean room comprising a wipe substrate wetted with a cleaning solution, the improvement which resides in a cleaning wipe having low volatile organic chemical and low nonvolatile residue properties comprising a wipe substrate wetted with a solution consisting essentially of water and from 0.001% to 0.5% by weight of an acetylenic diol.

4. The cleaning wipe of claim 3 wherein the acetylenic diol is present in the range of 0.01% to 0.3% by weight.

5. The cleaning wipe of claim 4 wherein the acetylenic diol is present in the range of 0.05% to 0.2% by weight.

6. The cleaning wipe of claim 5 wherein the acetylenic diol has a vapor pressure of at least $1\times10^{-4}$ torr at 25° C.

7. The cleaning wipe of claim 6 wherein the acetylenic diol has a vapor pressure of at least $1\times10^{-3}$ torr at 25° C.

8. The cleaning wipe of claim 7 wherein the acetylenic diol is dimethyl octynediol.

9. The cleaning wipe of claim 7 wherein the acetylenic diol is tetramethyl decynediol.

10. The cleaning wipe of claim 4 wherein the wipe substrate is selected from the group consisting of: cotton, abaca, polyester, nylon, polyester/cellulose, rayon, polypropylene, rayon/polyester, polypropylene/cellulose, polyurethane, cotton/polyester and mixtures thereof.

11. The cleaning wipe of claim 4 wherein the acetylenic diol is selected from the group consisting of: dimethyl octynediol; tetramethyl decynediol; 2,6,9,13-tetramethyl-2,12-tetradecadien-7-yne-6-9-diol; 2,6,9-trimethyl-2-decen-7-yne-6-9-diol; 7,10-dimethyl-8-hexadecyne-7,10-diol; 2,4,7,9-tetramethyl-5-decyne-4,7-diol; 4,7-dimethyl-5-decyne-4,7-diol; 3,6-diethyl-4-octyne-3,6-diol; 2,5-dicycloprpyl-3-hexyne-2,5-diol; 2,5-diphenyl-3-hexyne-2,5-diol; 3,5-dimethyl-1-hexyn-3-ol, 2,5,8,11-tetramethyl -6-dodecyne-5,8-diol and mixtures thereof.

12. The cleaning wipe of claim 11 wherein the wipe substrate is a fibrous substrate.

13. The cleaning wipe of claim 11 wherein the wipe substrate is a woven fibrous substrate.

14. The cleaning wipe of claim 11 wherein the wipe substrate is a nonwoven fibrous substrate.

15. The cleaning wipe of claim 11 wherein the wipe substrate is a sponge.

16. The cleaning wipe of claim 11 wherein the water is high purity water.

17. The cleaning wipe of claim 11 wherein the water is deionized water.

18. The cleaning wipe of claim 11 wherein the water is distilled water.

* * * * *